United States Patent [19]

Degner et al.

[11] 4,411,746

[45] Oct. 25, 1983

[54] PREPARATION OF ALKYL-SUBSTITUTED BENZALDEHYDES

[75] Inventors: Dieter Degner, Dannstadt-Schauernheim; Hans Roos, Bad Durkheim; Heinz Hannebaum, Ludwigshafen, all of Fed. Rep. of Germany

[73] Assignee: BASF Aktiengesellschaft, Fed. Rep. of Germany

[21] Appl. No.: 400,699

[22] Filed: Jul. 22, 1982

[30] Foreign Application Priority Data

Aug. 19, 1981 [DE] Fed. Rep. of Germany ..... 3132726

[51] Int. Cl.[3] ..... C25B 3/02; C25B 11/06

[52] U.S. Cl. ..... 204/59 R; 204/78; 204/290 R

[58] Field of Search ..... 204/78–79, 204/294, 291, 290 R, 59 R

[56] References Cited

U.S. PATENT DOCUMENTS

| | | | |
|---|---|---|---|
| 3,977,959 | 8/1976 | Habermann et al. | 204/290 R |
| 4,148,696 | 4/1979 | Halter | 204/59 R |
| 4,285,799 | 8/1981 | De Nora et al. | 204/290 R |

FOREIGN PATENT DOCUMENTS 2855508 7/1981 Fed. Rep. of Germany .

OTHER PUBLICATIONS

Helv. Chim. Acta 9, (1926), pp. 1097–1101.

*Primary Examiner*—R. L. Andrews
*Attorney, Agent, or Firm*—Keil & Witherspoon

[57] ABSTRACT

A process for the preparation of alkyl-substituted benzaldehydes by electrooxidation of alkylbenzenes using graphite anodes coated with metal oxides or with carbides.

1 Claim, No Drawings

PREPARATION OF ALKYL-SUBSTITUTED BENZALDEHYDES

The present invention relates to a process for the electrochemical preparation of alkyl-substituted benzaldehydes.

Helv. Chim. Acta 9 (1926), 1097 discloses the electrosynthesis of alkyl-substituted benzaldehydes by anodic oxidation of the corresponding alkylbenzenes. In this process, in which the electrooxidation is carried out in sulfuric acid solution, the selectivity of aldehyde formation is very low. U.S. Pat. No. 4,148,696 discloses a process in which the electrooxidation is carried out with an electrolyte which, in addition to the alkylbenzene, contains water, methylene chloride, propionic acid and sodium propionate, and quaternary ammonium salts as phase transfer reagents. In this process also, only low yields of aldehydes are obtained. Working up of the electrolysis products and recycling of the electrolytes are so expensive that they prevent industrial exploitation. German Laid-Open application DOS No. 2,855,508 discloses a process in which the electrooxidation of the alkylbenzenes is carried out in water and alkanoic acids to give good yields of the alkyl-substituted benzaldehydes. However, the disadvantage of this process is the drop in current yield at very high conversions. Moreover, the graphite of the anode wears away in sustained-use tests.

It is an object of the present invention to provide a process for the preparation of benzaldehydes by electrooxidation of the corresponding alkylbenzenes, which gives good current yields even at high conversions, and improved electrode stability.

We have found that this object is achieved in a process for the preparation of alkyl-substituted benzaldehydes of the general formula

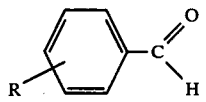

I where $R^1$ is hydrogen, alkyl or aryl, by electrooxidation of alkylbenzene derivatives of the general formula

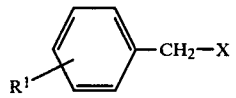

II where X is hydrogen, hydroxyl or $R^2COO$—, $R^2$ being hydrogen or alkyl, in water or an alkanoic acid, wherein graphite anodes coated with metal oxides or with carbides are used.

Graphite anodes coated with metal oxides, e.g. ruthenium oxide, titanium dioxide, iron oxide, chromium oxide, cobalt oxide, manganese dioxide and nickel oxide, or with carbides, e.g. tungsten carbide, are used in the novel process, in which the benzaldehydes of the formula I are obtained at high conversions with high material yields and high current yields. Mixtures of the above coating materials, e.g. a mixture of iron oxide and cobalt oxide, can also be used.

Alkyl $R^1$ or $R^2$ in the starting materials of the formula II is, for example, alkyl of 1 to 6, preferably 1 to 4, carbon atoms. Aryl $R^1$ includes phenyl, which may be substituted by alkyl, halogen, alkoxy and/or acyloxy.

Starting materials of the formula II are thus methylbenzenes, benzyl alcohols and alkanoic acid esters of benzyl alcohols which are unsubstituted or contain $R^1$, e.g. toluene, p-xylene, p-tert.-butyltoluene, p-phenyl-toluene, benzyl alcohol, p-methylbenzyl alcohol, p-tert.-butylbenzyl alcohol, benzyl acetate, p-methylbenzyl acetate and p-tert.-butylbenzyl acetate. p-Xylene, p-tert.-butyltoluene, p-methylbenzyl alcohol, p-tert.-butylbenzyl alcohol, p-methylbenzyl acetate and p-tert.-butylbenzyl acetate are of particular industrial interest.

Preferred alkanoic acids are formic acid, acetic acid and propionic acid.

A mixture of the benzene derivative of the formula II, water and the alkanoic acid is used as the electrolyte, which may additionally contain a conductive salt to improve the conductivity. Suitable conductive salts are the salts conventional in organic electrochemistry which are soluble in the solution to be electrolyzed and substantially stable under the experimental conditions, for example tetrafluoborates, fluorides, hexafluorophosphates, sulfates and sulfonates. The process is preferably carried out in non-compartmented cells.

Examples of suitable cathodes are graphite, iron, steel, lead and noble metal electrodes. Preferably, not less than 80% of the alkylbenzene compound of the formula II is converted. The current density in the process is, for example, from 1 to 15 $A/dm^2$. The electrolysis can be carried out either batchwise or continuously. The electrolysis products are preferably worked up by distillation, and the electrolyte, consisting of water, alkanoic acid and conductive salt, is advantageously recycled to the electrolysis.

The graphite anodes to be used according to the invention can be prepared, for example, by coating the electrode substrates by thermal spraying or by thermal decomposition of suitable compounds. In the first case, the oxides or carbides are fed directly, in powder form, to a spraying unit, preferably a plasma spraying unit, and are applied therewith to the graphite substrate. In the second case, the dissolved compound is applied to the graphite substrate and the active coating is produced by baking at elevated temperature. Thus, for example, a titanium oxide coating is produced by spraying or brushing the electrode with butyl titanate in butanol and then heating it to from 500° to 600° C.

Surprisingly, the above coated anodes improve the selectivity and increase the current yields, even at high conversions, in the process of the invention, thereby substantially simplifying working up of the electrolysis products. Moreover, as a result of reduced wear, longer running times of the graphite electrodes can be achieved.

The Example which follows illustrates the process according to the invention with reference to the electrosynthesis of 4-tert.-butylbenzaldehyde.

EXAMPLE

Course of the reaction:

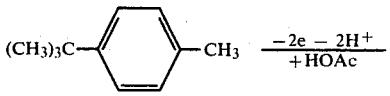

(TBT)

-continued

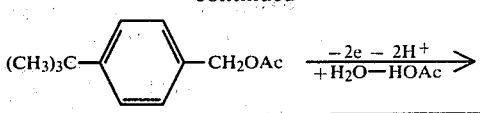

(TBAc)

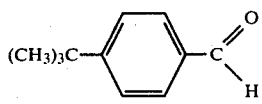

(TBA)

Apparatus: non-compartmented cell
Anodes: coated graphite anodes (for the coating, cf. the Table)
Electrolyte:
16.2% by weight of 4-tert.-butyltoluene (TBT)
1.6% by weight of $NaBF_4$
8.2% by weight of water
74.0% by weight of acetic acid (HOAc)
Cathodes: graphite
Current density: 5.3 A/dm$^2$
Temperature: 55°-65° C.

The electrolyte is pumped over a heat exchanger during the electrolysis. When the electrolysis has ended the water and acetic acid are distilled off under atmospheric pressure, the $NaBF_4$ is filtered off and the crude 4-tert.-butylbenzaldehyde (TBA) is purified by distillation at from 40° to 125° C. under from 2 to 20 mm Hg.

The experimental results are summarized in the Table which follows:

TABLE

Electrosynthesis of 4-tert.-butylbenzaldehyde

| Example | Anode coating on graphite | Quantity of electricity employed (Q) (F/moles of TBT) | Conversion (%) TBT | Conversion (%) TBAc | Yield (%) TBA | Current yield (%) TBA |
|---|---|---|---|---|---|---|
| 1 | $Cr_2O_3$ | 5.0 | 100 | 90.4 | 86.7 | 66.7 |
| 2 | tungsten carbide | 5.0 | 100 | 95.2 | 80.3 | 63.1 |
| 3 | nickel oxide | 5.0 | 100 | 80.6 | 84.4 | 62.2 |
| 4 | $MnO_2$ | 5.0 | 100 | 70.3 | 85.3 | 59.9 |
| 5 | titanium dioxide | 5.0 | 100 | 83.3 | 83.5 | 62.4 |
| 6 | $Fe_3O_4$ (70%) $Co_3O_4$ (30%) | 4.9 | 100 | 84.5 | 82.6 | 63.3 |
| 7 | $RuO_2/TiO_2$ | 5.0 | 100 | 89.0 | 77.0 | 61.0 |
| Comparative | uncoated | 5.5 | 100 | 93.1 | 71.3 | 50.8 |

We claim:

1. In a process for preparing an alkyl-substituted benzaldehyde of the formula

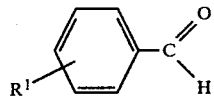

I wherein $R^1$ is hydrogen, alkyl or aryl by electrooxidation of an alkylbenzene derivative of the formula

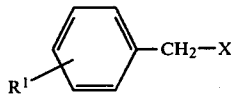

II wherein $R^1$ is as defined above,

X is hydrogen, hydroxy or $R^2COO^-$, and $R^2$ is hydrogen or alkyl, in water or an alkanoic acid, the improvement which comprises: conducting the electrooxidation using graphite anodes coated with a metal oxide or carbide selected from the group consisting of ruthenium oxide, titanium dioxide, iron oxide, chromium oxide, cobalt oxide, manganese dioxide, nickel oxide or tungsten carbide.

* * * * *